US008365801B1

(12) United States Patent
Motosko et al.

(10) Patent No.: US 8,365,801 B1
(45) **Date of Patent: *Feb. 5, 2013**

(54) ROLL-UP/DOWN STORM SHUTTER HAVING CORRUGATED SHUTTER SLATS

(76) Inventors: Stephen J. Motosko, Sarasota, FL (US); Stephen Motosko, III, Sarasota, FL (US)

( * ) Notice: Subject to any disclaimer, the term of this patent is extended or adjusted under 35 U.S.C. 154(b) by 588 days.

This patent is subject to a terminal disclaimer.

(21) Appl. No.: 12/507,896

(22) Filed: Jul. 23, 2009

(51) Int. Cl.
*E06B 3/12* (2006.01)

(52) U.S. Cl. ..... 160/235; 160/133; 160/236

(58) Field of Classification Search ..... 160/32, 160/133, 33, 235, 229.1, 236, 183, 181, 187, 160/210, 232
See application file for complete search history.

(56) References Cited

U.S. PATENT DOCUMENTS 682,304 A * 9/1901 Wilson ..... 160/235
746,307 A * 12/1903 Ebner ..... 160/235
876,593 A * 1/1908 Rush ..... 160/235
1,367,240 A * 2/1921 Cornell ..... 160/235
1,406,303 A * 2/1922 Tomkinson ..... 160/235
1,437,947 A * 12/1922 Probert ..... 160/235
1,579,839 A * 4/1926 Raper ..... 160/235
1,579,915 A * 4/1926 Cornell ..... 160/133
1,632,219 A * 6/1927 Deller ..... 160/235
2,093,054 A * 9/1937 Bruno ..... 160/235
2,350,287 A * 5/1944 Michelman ..... 160/133
2,585,627 A * 2/1952 Cornell et al. ..... 160/180
2,638,162 A * 5/1953 Heitlinger et al. ..... 160/38
2,770,298 A * 11/1956 Hiatt ..... 160/232
2,835,935 A * 5/1958 Housley ..... 52/507
3,053,318 A * 9/1962 Artman ..... 160/231.2
3,481,388 A * 12/1969 Smart ..... 160/84.08
3,642,050 A * 2/1972 Piana ..... 160/133
4,126,173 A 11/1978 Theuerkauff
4,175,357 A 11/1979 Goldhaber
4,182,144 A 1/1980 Leivenzon et al.
4,234,033 A 11/1980 Leivenzon et al.
4,332,287 A 6/1982 Stolpe
4,343,340 A * 8/1982 Paule ..... 160/232
4,345,635 A 8/1982 Solomon
4,382,460 A * 5/1983 Ben-Tal ..... 160/236

(Continued)

OTHER PUBLICATIONS

The American Heritage® Dictionary of the English Language, Fourth Edition. S.v. "corrugated." Retrieved Dec. 2, 2011 from http://www.thefreedictionary.com/corrugated.*

(Continued)

*Primary Examiner* — Katherine w Mitchell
*Assistant Examiner* — Johnnie A Shablack
(74) *Attorney, Agent, or Firm* — Gifford, Krass, Sprinkle, Anderson & Citkowski, P.C.

(57) ABSTRACT

A roll type storm shutter including a plurality of elongated horizontally extending preferably corrugated shutter slats held together in an edge-to-edge arrangement. Each of the storm slats has complimentary first and second edges configured to slidably and interlockingly engage with a next adjacent slat for limited pivotal movement therebetween to facilitate rolled vertical deployment and retraction of the storm shutter. A central portion between the edges of each slat preferably has lengthwise extending corrugations for greater impact resistance to better withstand the impact of airborne flying objects produced during storms and hurricanes. Elongated solid panels may be provided each having enlarged parallel edge portions configured and spaced apart for dependent lengthwise slidable engagement between either inwardly or outwardly positioned grooves formed proximate to the edges of each of the slats. Each of said panels is coextensive with and preferably contacting inwardly or outwardly facing corrugation peaks, respectively, to further enhance the impact resistance of the storm shutter.

7 Claims, 14 Drawing Sheets

U.S. PATENT DOCUMENTS

| | | | | | |
|---|---|---|---|---|---|
| 4,433,711 | A | | 2/1984 | Lew | |
| 4,433,714 | A | * | 2/1984 | Barber | 160/235 |
| 4,601,953 | A | * | 7/1986 | Haffer | 428/457 |
| 4,628,982 | A | * | 12/1986 | Labelle | 160/235 |
| 4,630,664 | A | * | 12/1986 | Magro | 160/232 |
| 4,690,193 | A | | 9/1987 | Morrison et al. | |
| 4,809,760 | A | | 3/1989 | Lew | |
| 4,811,777 | A | | 3/1989 | Chretien | |
| 4,913,216 | A | * | 4/1990 | Lemay | 160/236 |
| 5,172,744 | A | | 12/1992 | Finch et al. | |
| 5,209,282 | A | * | 5/1993 | Franco et al. | 160/236 |
| 5,284,199 | A | | 2/1994 | Finch et al. | |
| 5,301,735 | A | * | 4/1994 | Chen | 160/199 |
| 5,322,108 | A | * | 6/1994 | Hoffman | 160/236 |
| 5,358,024 | A | * | 10/1994 | Schwaegerle | 160/236 |
| 5,419,386 | A | * | 5/1995 | Magro et al. | 160/232 |
| 5,456,305 | A | | 10/1995 | Snarli | |
| 5,477,903 | A | | 12/1995 | Figueiredo et al. | |
| 5,507,335 | A | | 4/1996 | Yu | |
| 5,515,902 | A | * | 5/1996 | Hoffman | 160/235 |
| 5,549,148 | A | | 8/1996 | Figueiredo et al. | |
| 5,575,322 | A | | 11/1996 | Miller | |
| 5,613,539 | A | * | 3/1997 | Kraler | 160/32 |
| 6,041,847 | A | | 3/2000 | Lai | |
| 6,064,525 | A | | 5/2000 | Depauw | |
| 6,065,525 | A | | 5/2000 | Wells | |
| 6,067,911 | A | | 5/2000 | Marker et al. | |
| 6,148,895 | A | | 11/2000 | Biggers | |
| 6,263,943 | B1 | | 7/2001 | Lai | |
| 6,279,641 | B1 | * | 8/2001 | Malott | 160/67 |
| 6,296,039 | B1 | | 10/2001 | Mullet et al. | |
| 6,341,639 | B1 | | 1/2002 | Mullet et al. | |
| 6,371,189 | B1 | * | 4/2002 | Azoulai | 160/133 |
| 6,422,289 | B1 | * | 7/2002 | Miller | 160/133 |
| 6,435,101 | B1 | | 8/2002 | Marker et al. | |
| 6,755,231 | B1 | | 6/2004 | Biggers | |
| 7,121,316 | B2 | * | 10/2006 | Biggers | 160/183 |
| 7,328,613 | B2 | * | 2/2008 | Volkel et al. | 73/432.1 |
| 7,357,171 | B2 | * | 4/2008 | Miller | 160/235 |
| D601,716 | S | * | 10/2009 | Konrad et al. | D25/49 |
| 7,784,522 | B2 | * | 8/2010 | Miller | 160/235 |
| 7,900,681 | B2 | * | 3/2011 | Sweeney | 160/210 |
| 2003/0024659 | A1 | * | 2/2003 | Begni | 160/235 |
| 2003/0066249 | A1 | | 4/2003 | Walsh | |
| 2005/0205222 | A1 | * | 9/2005 | Miller | 160/236 |
| 2005/0205223 | A1 | * | 9/2005 | Miller | 160/236 |
| 2006/0283563 | A1 | * | 12/2006 | Volkel et al. | 160/236 |
| 2007/0056695 | A1 | * | 3/2007 | Chang | 160/206 |
| 2007/0137802 | A1 | * | 6/2007 | Lukasik et al. | 160/235 |
| 2007/0175117 | A1 | | 8/2007 | Brown | |
| 2008/0202700 | A1 | * | 8/2008 | Miller | 160/133 |
| 2009/0266497 | A1 | * | 10/2009 | Motosko et al. | 160/133 |
| 2010/0212842 | A1 | * | 8/2010 | Bichler | 160/133 |

OTHER PUBLICATIONS

The American Heritage® Dictionary of the English Language, Fourth Edition. S.v. "zigzag." Retrieved Dec. 2, 2011 from http://www.thefreedictionary.com/zigzag.*

* cited by examiner

ROLL-UP/DOWN STORM SHUTTER HAVING CORRUGATED SHUTTER SLATS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to roll-up/down (or "roll-type") shutters for storm, hurricane and security protection, and more particularly to corrugated shutter slats for storm shutters.

2. Description of Related Art

Roll-up/down storm shutters are well known and afford a great deal of window and interior protection from storms, hurricanes and from breaking and entering into a home or building through otherwise unprotected windows and doors. These roll-type shutters are formed of a plurality of interlocking horizontally extending slats which have limited pivotal motion therebetween and are typically arcuately configured in cross section to facilitate the roll-up storage of the storm shutters when not in use.

U.S. Pat. No. 6,263,943 to Lai teaches a modular rolling shutter comprised of vertically alternating rows of buckles and slats. Each slat is linked with the lower and upper buckles, allowing limited movement of the slats and buckles so that the modular shutter may be rolled and unrolled along tracks. The slats may be made of a transparent material allowing visibility without sacrificing weather resistance or security. U.S. Pat. No. 6,041,847 also to Lai discloses a building block for a rolling shutter made of plastic sheets.

A rolling door construction which is easily assembled and which includes a plurality of light-transmitting panels is taught in U.S. Pat. No. 4,332,287 to Stolpe. Snarli teaches a rollable or foldable shutter device for protecting, closing off or partitioning of areas, such as window areas in U.S. Pat. No. 5,456,305. The shutter is provided with panels made from a transparent material, such as polycarbonate, and hinges which are mounted so that it can be folded or rolled up. The hinges and the panels may be made in one piece. When the device is used, at least a part of the transparency remains.

U.S. Pat. No. 4,345,635 to Solomon discloses a rolling protective gate for store fronts or the like which is formed of a series of horizontally-extending transparent slats interconnected and articulated by a series of horizontally-extending metal rods. The transparent slats and metal rods are elongated, and each extends the full width of the building front access opening in which the rolling gate is mounted.

In U.S. Patent Application Publication No. US 2007/0175117, Brown teaches a storm shutter look out portal for storm shutters comprised of an assembly with an interior frame and an exterior frame enclosing at least one transparent panel in between, and also including a cover associated with the interior frame that is moveable from a closed position to an open position where the cover, the interior frame and the exterior frame, are all fabricated from materials that are resistant to the impacts anticipated during a hurricane or tropical storm.

Expired U.S. Pat. No. 4,690,193 to Morrison et al. discloses a rolling shutter characterized by an array of edge-adjacent, parallel shutter slats and full shutter width, clear shutter segments or links articulately interconnecting respective pairs of adjacent shutter slats. When spaced apart, the slats form therebetween a gap which exposes the clear link which permits passage of light over substantially the full extent of the gap. The clear links also provide a double hinge-like joint between adjacent slats.

Goldhaber teaches a protective enclosure for building openings such as windows and doorways wherein the protective enclosure comprises a peripheral frame member that circumscribes the openings and pivotally mounts a transparent shielding unit in U.S. Pat. No. 4,175,357.

A shutter with profiled strips made of transparent plastic is disclosed in U.S. Pat. No. 4,126,173 to Theuerkauff. U.S. Pat. No. 5,507,335 to Yu teaches a shutter with a plurality of slat units which have transparent portions through which an object behind the same can be viewed.

U.S. Pat. No. 4,234,033 to Leivenzon et al. discloses a corrugated roller door and frame combination. Wells teaches a roll-up door assembly including a corrugated flexible sheet closure member in U.S. Pat. No. 6,064,525. A roller shutter door is taught in U.S. Pat. No. 4,433,714 to Barber.

Biggers discloses shutter systems for windows and doors which have pronounced corrugations when deployed in U.S. Pat. No. 6,148,895, U.S. Pat. No. 6,755,231 and U.S. Pat. No. 7,121,316. Roll-up door systems are taught by Finch et al. in U.S. Pat. Nos. 5,172,744 and 5,284,199.

U.S. Pat. No. 4,811,777 to Chretien discloses a device for at least partially closing a vertical opening in a building. A rolling shutter system is taught by Miller In U.S. Pat. No. 5,575,322.

Recent building code restrictions have dramatically increased impact strength requirements for doors and windows and devices intended to afford protection from storm and hurricane damage due to wind-driven flying objects. Current hurricane protection must now be stringently tested and qualified for production and code acceptance under test conditions not imagined two decades ago. As a result, not only have the overall impact strength requirements been increased, but the uniqueness of the testing requirements are forcing development of specialized hurricane protection structure to, at least in part, meet specific code testing requirements. The present invention provides both preferably corrugated, as well as flattened and doubled roll-up type storm shutter slats which greatly increase the ability of these storm shutters in meeting these new hurricane testing codes by affording a substantially greater resistance to flying object impact when that flying object strikes directly against the center of one of the slats rather than impacting against a stronger knuckle hinge area between shutter slats.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a roll-up type storm shutter including a plurality of elongated horizontally extending preferably corrugated shutter slats held together in an edge-to-edge vertical arrangement. Each of the storm slats has first and second edges configured to slidably and interlockingly engage with a next adjacent slat for limited pivotal movement therebetween to facilitate rolled vertical deployment and retraction of the storm shutter. A central portion between the edges of each slat preferably has lengthwise extending corrugations for greater impact resistance to better withstand the impact of airborne flying objects produced during storms and hurricanes. An elongated solid panel may be added to each slat, each panel having enlarged parallel edge portions configured and spaced apart for dependent lengthwise slidable engagement between inwardly facing grooves formed proximate to the edges of each of the slats. Each of the panels is coextensive with and preferably contacting outwardly facing corrugation peaks to further enhance the impact resistance of the storm shutter. Moreover, each panel may be formed being sun and heat reflective for reducing heat buildup within the building.

It is therefore an object of this invention to provide a corrugated shutter slat for storm shutters which substantially increases flying object impact resistance.

Still another object of this invention is to provide a corrugated shutter slat for storm shutters which includes an easily assemblable two-part structure including a separate panel which slidably engages into mating groove structure of the corrugated slat for still further resistance to storm and hurricane airborne objects' impact damage, and, when the panels are heat and sun reflective, will reduce heat buildup in the building.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
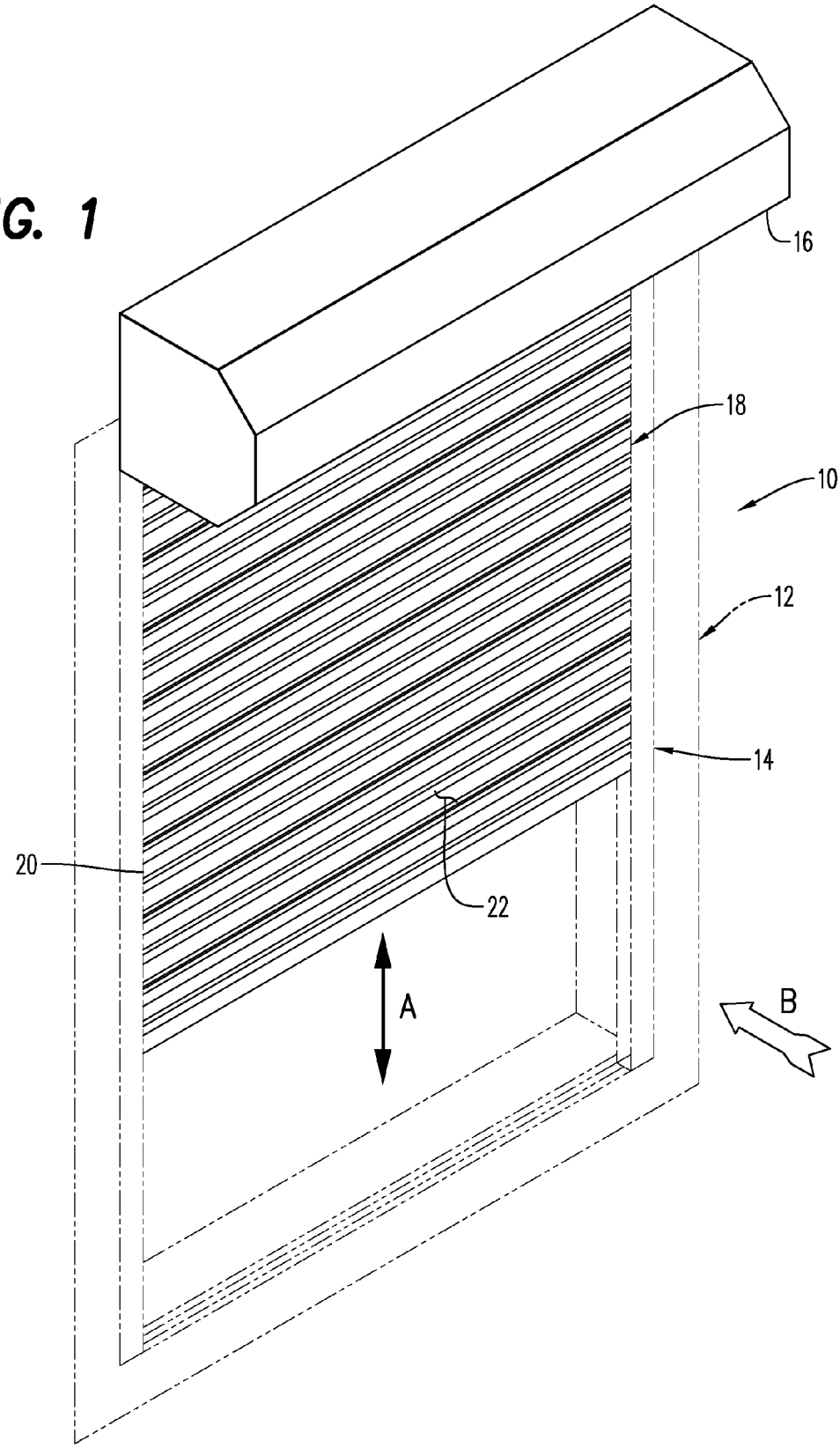
FIG. 1 is a perspective view of a roll-type storm shutter 10 showing adjacent window structure in phantom.
Figure 2:
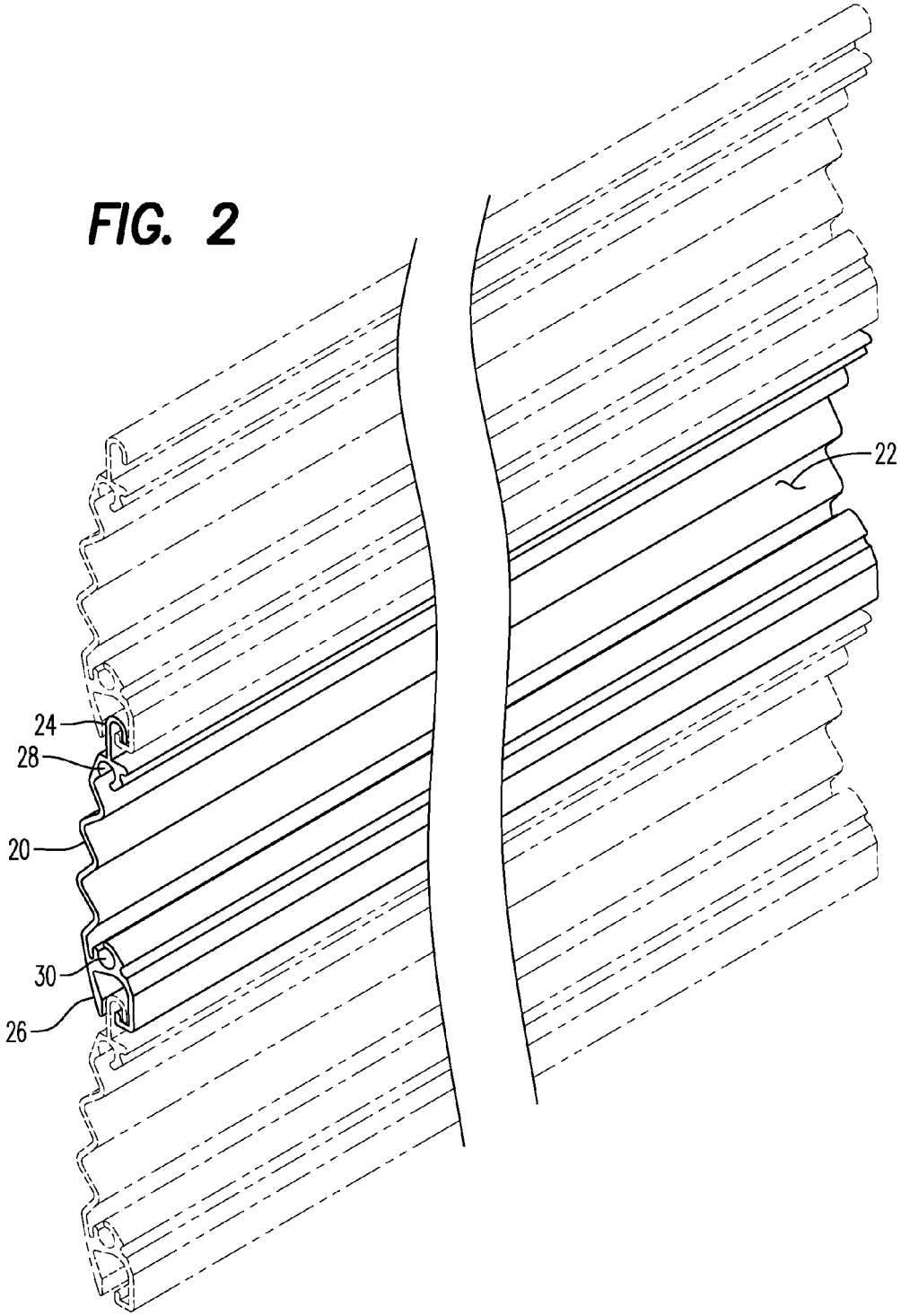
FIG. 2 is a perspective view of a storm shutter 20 showing adjacent such storm shutters in phantom interengaged to form a section of storm shutter.
Figure 3:
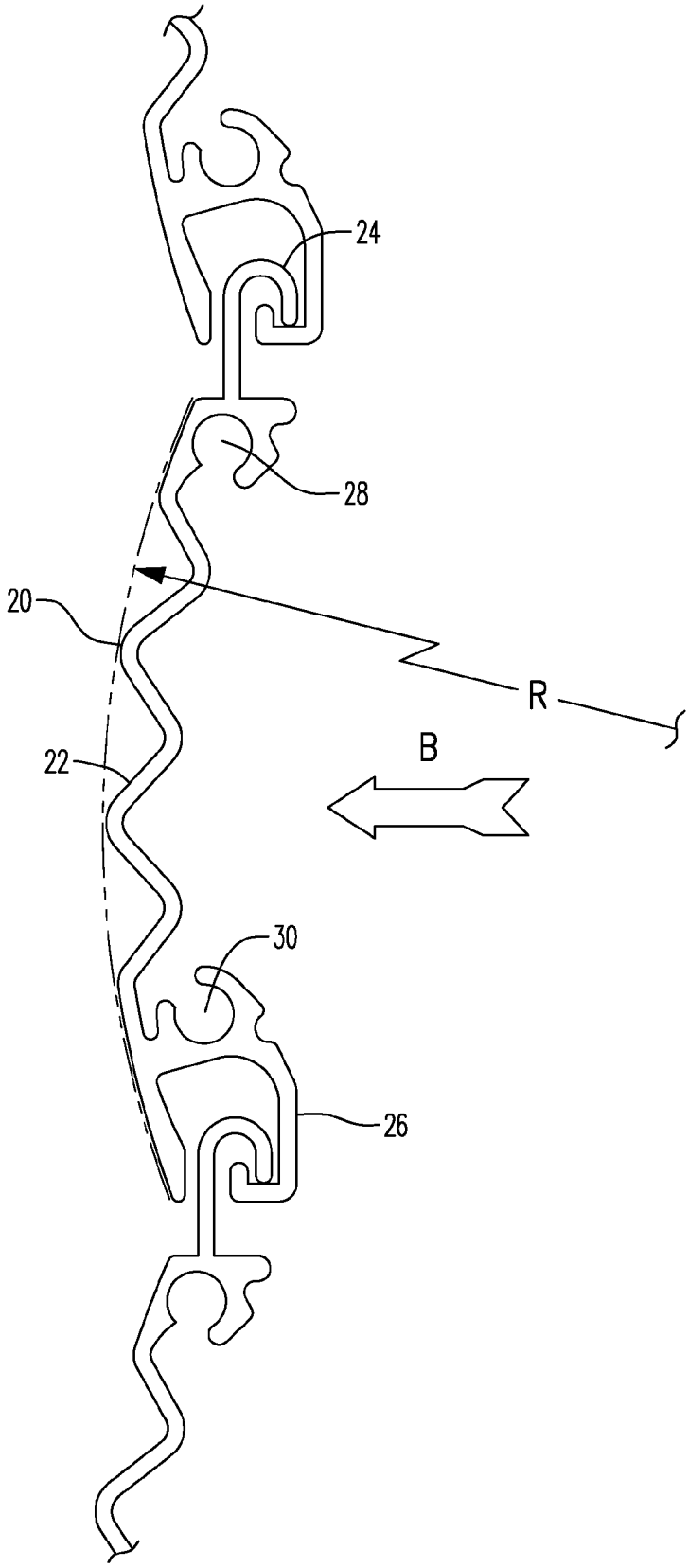
FIG. 3 is an enlarged end elevation view of a portion of FIG. 2.
Figure 4:
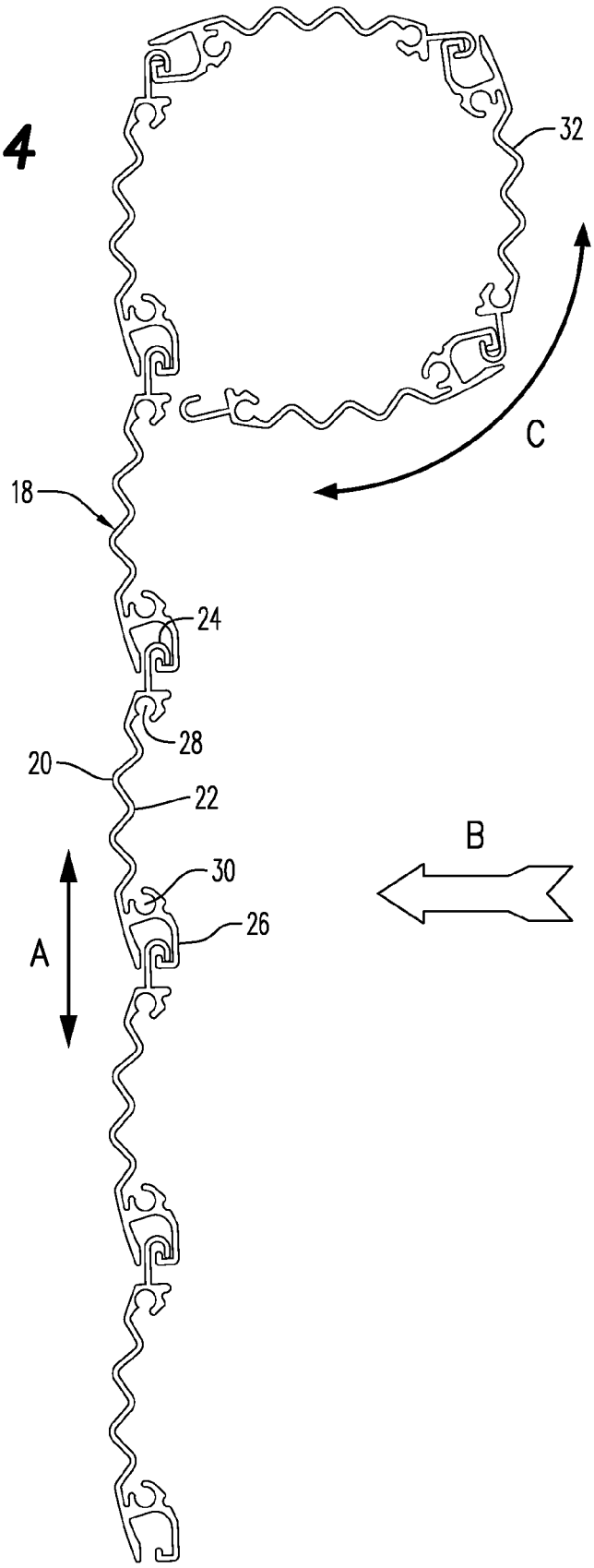
FIG. 4 is an end elevation view of an entire storm shutter absent support structure for clarity.

Referring now to the drawings, and firstly to FIGS. 1 to 5, one embodiment of the invention is there shown generally at numeral 18 in FIG. 1 in conjunction with the outside of a window frame 12, the entire installation shown at numeral 10. One of the shutter slats 20 is shown in FIG. 2 from the outside in conjunction with additional adjacent shutter slats 20 shown in phantom. Referring particularly to FIGS. 1 and 4, the storm shutter 18 is vertically movable in the direction of arrow A within spaced parallel upright shutter rails or guides 14 attached to the window frame 12. An upper horizontal housing 16 provides an enclosure for all of the shutter slats 32 which are storable therewithin by being rolled together in the direction of arrow C by a well-known drive mechanism (not shown). By this generally well-known roll-up arrangement, all or a portion of the storm shutter 18 may be rolled into and held within the housing 16 or deployed as desired.

Each shutter slat 20 is preferably formed of extruded aluminum material having a uniform cross-section and vertically spaced edges 24 and 26. Edge 26 defines a channel while edge 24 defines a hook structure which slidably, matably engage and connect together as shown best in FIG. 3 with the next adjacent edge 26, and so on, to form the storm shutter 18. The inner surface configuration of the shutter slat 20 is preferably broadly arcuately convex at R to facilitate the rolled up compact storage configuration of the storm shutter 18 when not in use. Immediately adjacent to the edges 24 and 26 of each shutter slat 20 are opposing generally inwardly facing grooves 28 and 30, the purpose of which will be described herebelow.

Figure 5:
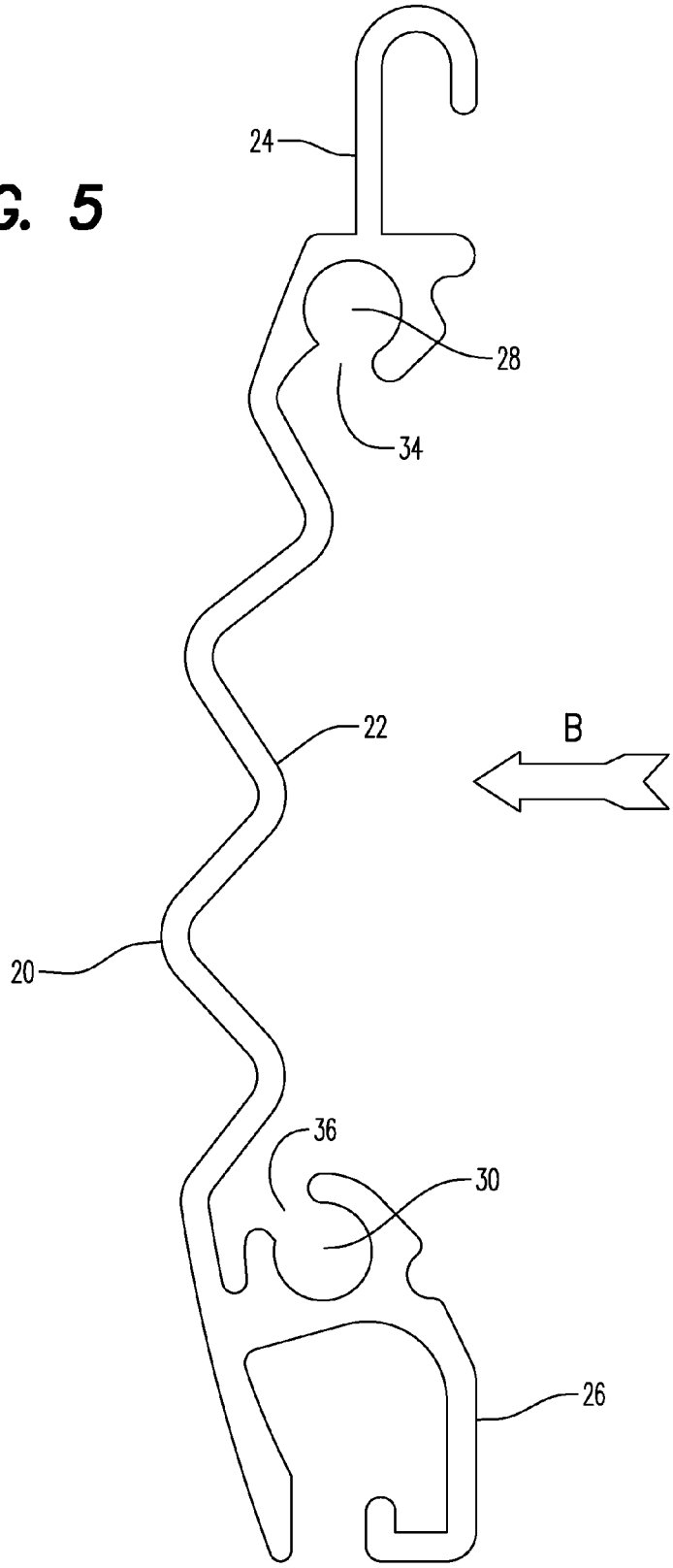
FIG. 5 is an enlarged end elevation view of one storm shutter slat of the previous figures.

The important aspect of the present invention resides in providing greater resistance to impacts imposed upon the storm shutter 18, and each of the individual shutter slats 20, by airborne objects during heavy storms and hurricanes. These flying objects, moving in the direction of arrow B against the outside of the storm shutter 18, may impact against the outer surfaces of the shutter slats 20 with great force at velocities exceeding 100 mph. Moreover, building test codes have been developed to simulate impacts of maximum or even greater or exaggerated severity to replicate hurricane force wind conditions. For example, as seen in FIGS. 3 and 5, one aspect of building test code compliance may very well include firing a missile directly at the center or central portion of the storm slat 20, typically the most vulnerable point of a roll-type hurricane shutter, at well over 100 mph. Where such slats are flat or very slightly arcuately shaped without corrugations or without double paneling or other reinforcement, such a hurricane slat may not be able to pass or survive such a direct impact test.

However, the embodiment 20 of a corrugated hurricane slat substantially increases the ability of the storm shutter 18 to survive a direct flying object impact in the direction of arrow B. These storm slats 20 include a plurality of generally evenly spaced corrugations or waves 22 formed having peaks and valleys (as shown) which greatly increase the resistivity of the storm shutter 18 to airborne flying object impact and potential bending-to-fracture impact forces. Moreover, the overall contour of these corrugations 22 is also preferably very gently arcuate, e.g., outwardly concaved at radius R in FIG. 3, to facilitate the necessary roll-up nesting feature at 32 depicted in FIG. 4 within the housing 16 as previously described.

Figure 6:
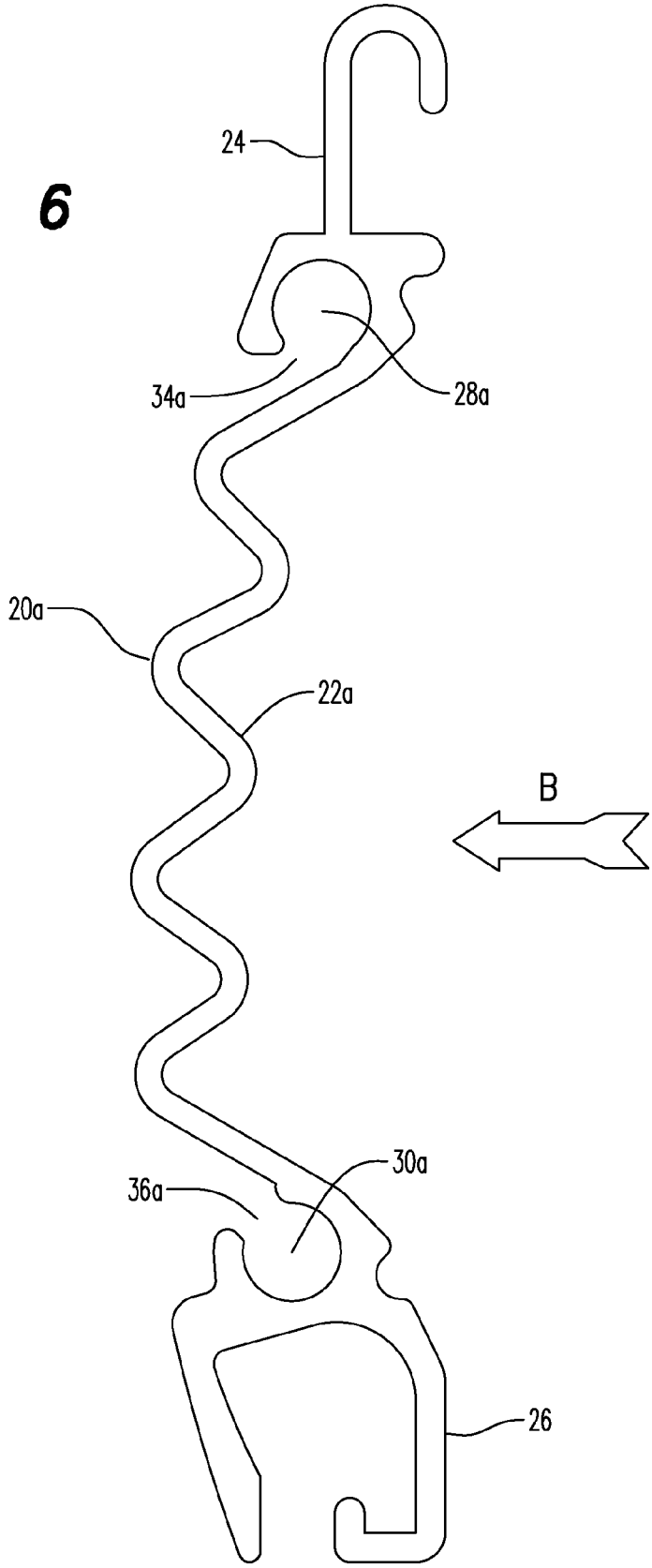
FIG. 6 is an alternate embodiment of FIG. 5.
Figure 7:
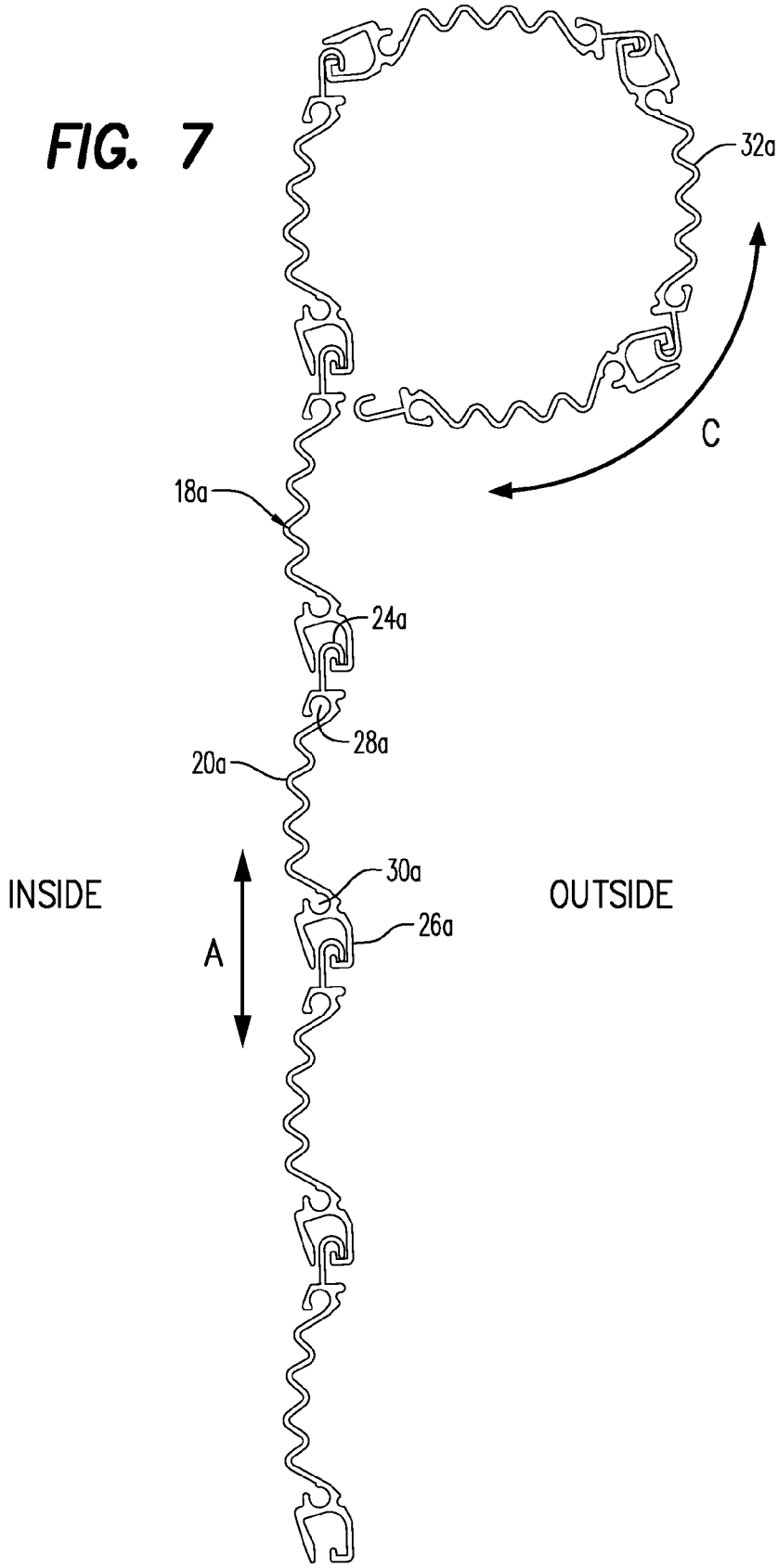
FIG. 7 is a view similar to FIG. 4 showing the alternate embodiment of the shutter slat of FIG. 6.

Note that the longitudinal facing channels 28 and 30 which are typically utilized for attachment of end fittings by threaded fasteners or for the end-to-end attachment of storm slats for excessively wide installations, the necessary slats or openings 34 and 36 formed during the extrusion process, are outwardly facing and are exposed to wind or flying debris in the direction of arrow B against the outer surface of each of the storm slats 20. However, in FIGS. 6 and 7, an alternate embodiment 20*a* of the storm slat is there shown wherein the cavities 28*a* and 30*a* face inwardly away from the direction of approaching wind and flying objects in the direction of arrow B and may avoid any issues of noise or whistling of wind into these cavities 28*a* and 30*a*, as well as avoiding debris gathering into these cavities through the gaps 34*a* and 36*a* leading to malfunction during deployment or retraction.

Figure 11:
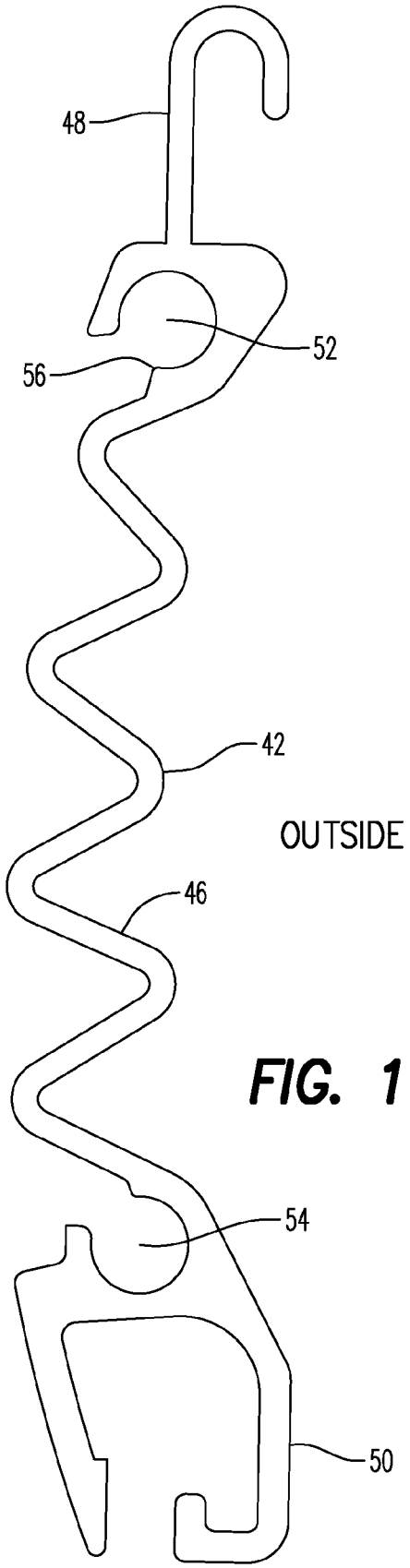
FIG. 11 is an end elevation view of the shutter slat of FIGS. 8 and 9.
Figure 12:
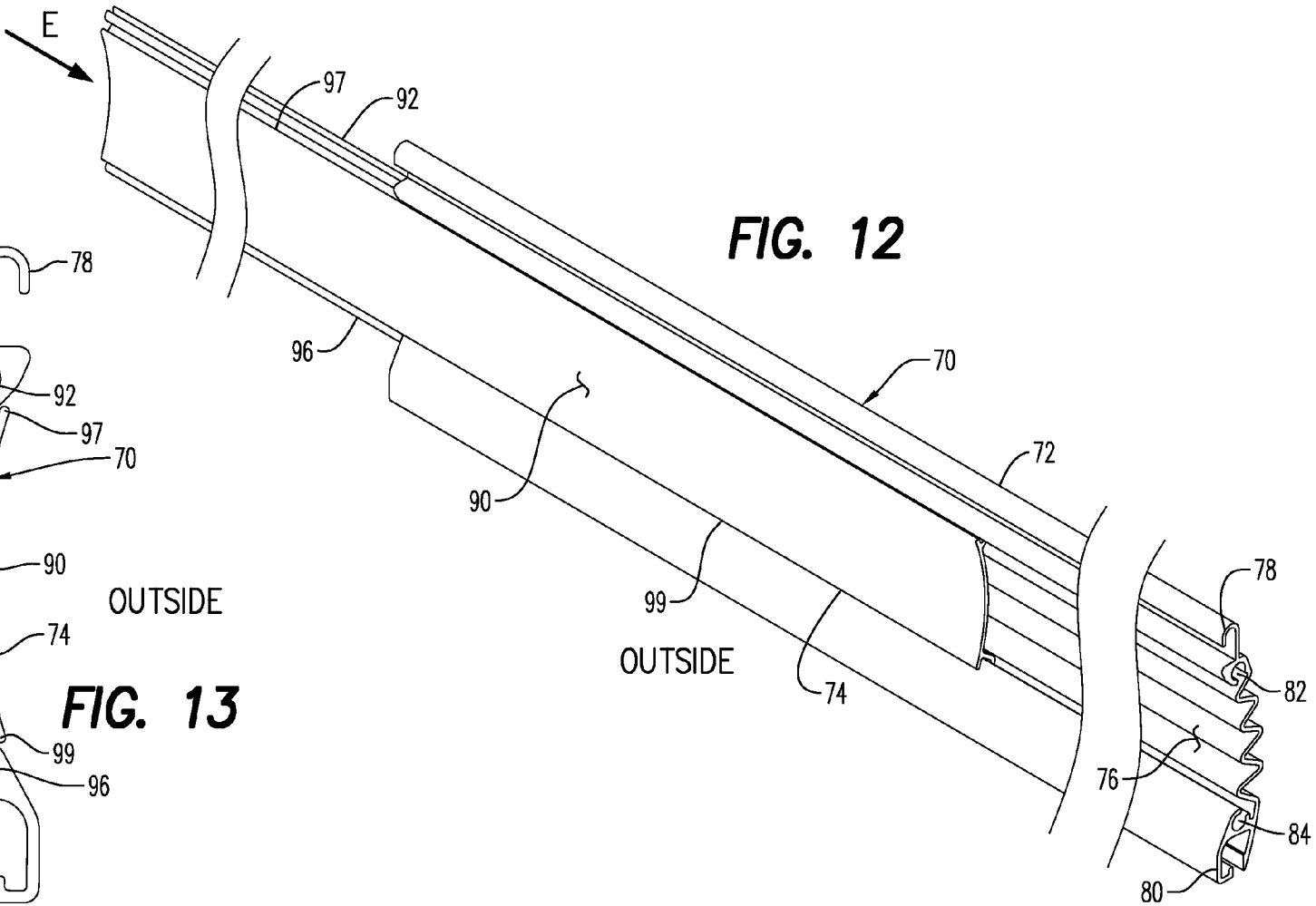
FIG. 12 is a perspective view of yet another embodiment of the shutter slat shown being assembled with another embodiment of a separate protective panel.

Referring now to FIGS. 8 to 11, another alternate embodiment of the invention is there shown generally at numeral 40 and includes a corrugated storm slat 42 which, as best seen in FIG. 11, includes a series of more closely spaced zigzag or wavy shaped corrugations 46 intended to stiffen and strengthen this storm slat 42 against impact damage due to flying objects produced during storms and hurricanes as previously described. The interlocking edge hinges 48 and 50 are as previously described to facilitate assembly and roll-up/roll-down of the entire storm shutter 40 itself.

Figures 8, 9:
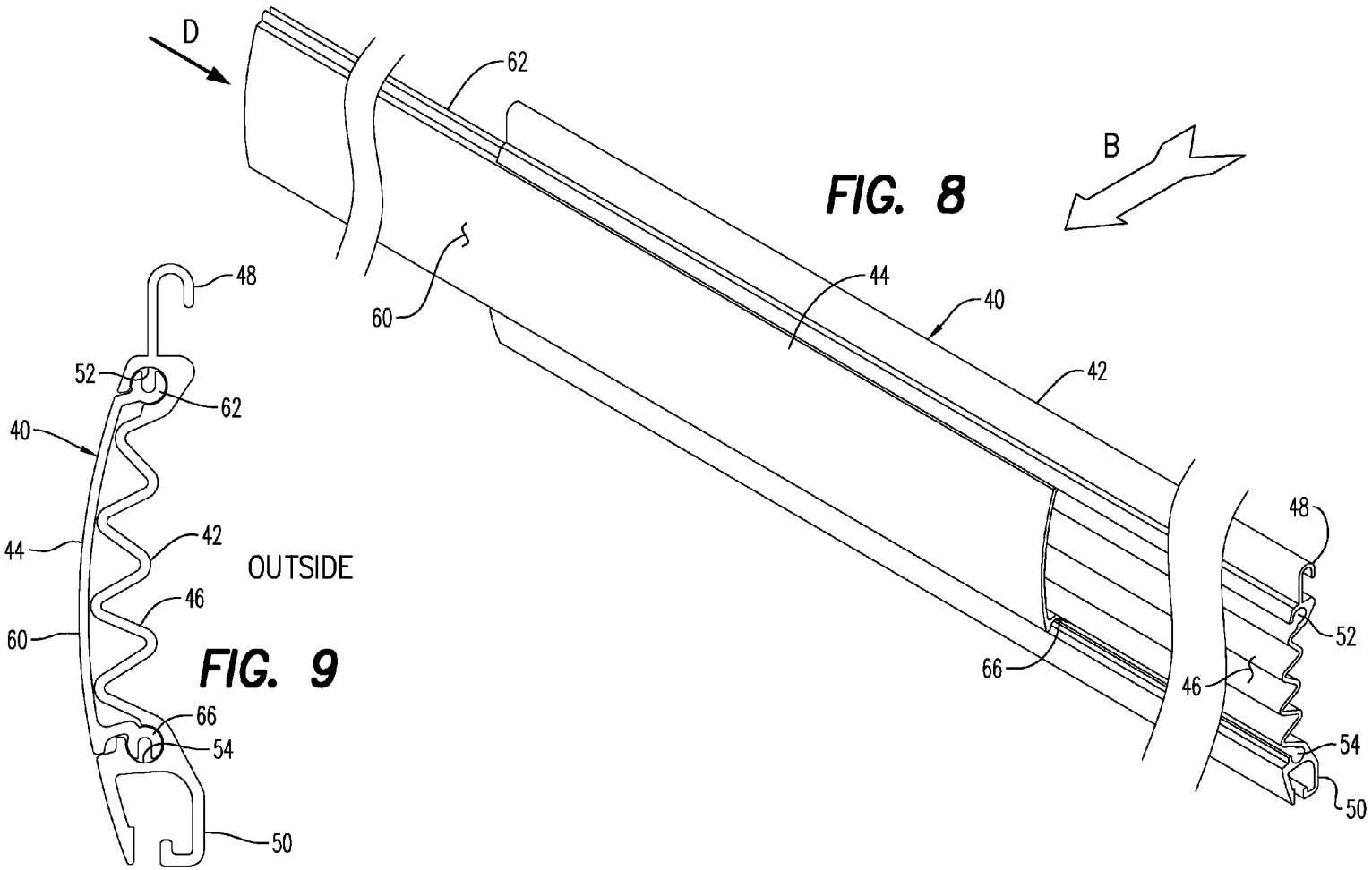
FIG. 8 is a perspective view of still another embodiment of the shutter slat shown being assembled with a separate protective panel.
FIG. 9 is an end elevation view of FIG. 8.
Figure 10:
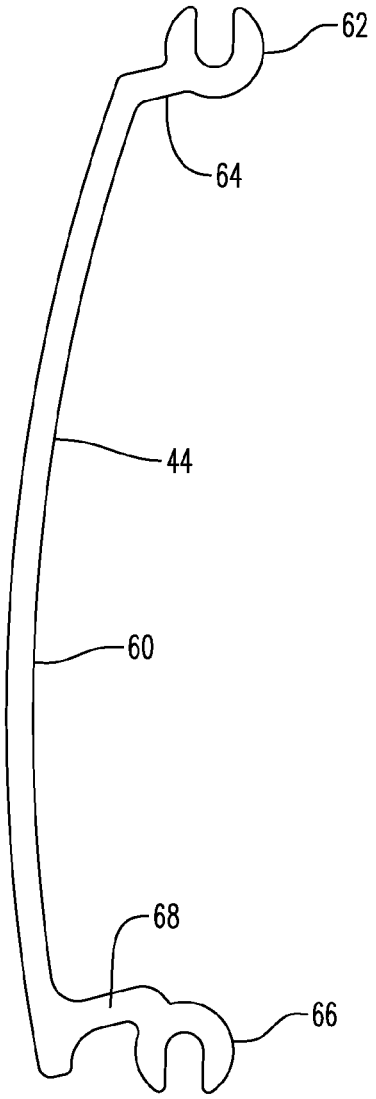
FIG. 10 is an end elevation view of the protective panel of FIGS. 8 and 9.

The longitudinally extending cavities 52 and 54, however, are sized and positioned to receive the enlarged or beaded edges 62 and 66 of a separate protective panel 44. This panel 44 is extruded of a wide range of extrudable metal, plastic or vinyl material having a solid arcuate central panel 60 which, in combination with the corrugations 46 of the storm slat 42, achieves an increased level of protection against flying object impact damage and penetration into the interior of the building therethrough. The enlarged edges 62 and 66 are offset at 64 and 68 so as to slidable engage lengthwise into the elongated cavities 52 and 54 as best seen in FIG. 8 in the direction of arrow D. When the storm slat 42 and protective panel 44 are coextensively engaged one to another into the configuration best seen in FIG. 9, the central arcuate portion 60 is configured to make slight contact with, or be in very close proximity to, the outwardly extending peaks of the corrugations 46 so that both of these components 42 and 44 structures act in unison to resist impact damage during storms.

Figure 13:
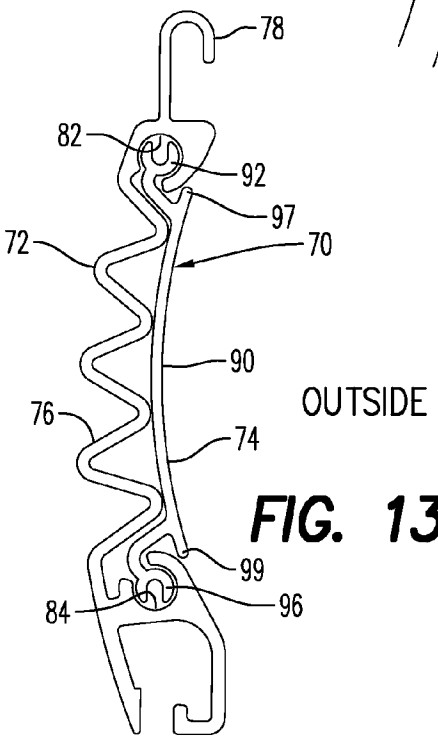
FIG. 13 is an end elevation view of FIG. 12.
Figure 14:
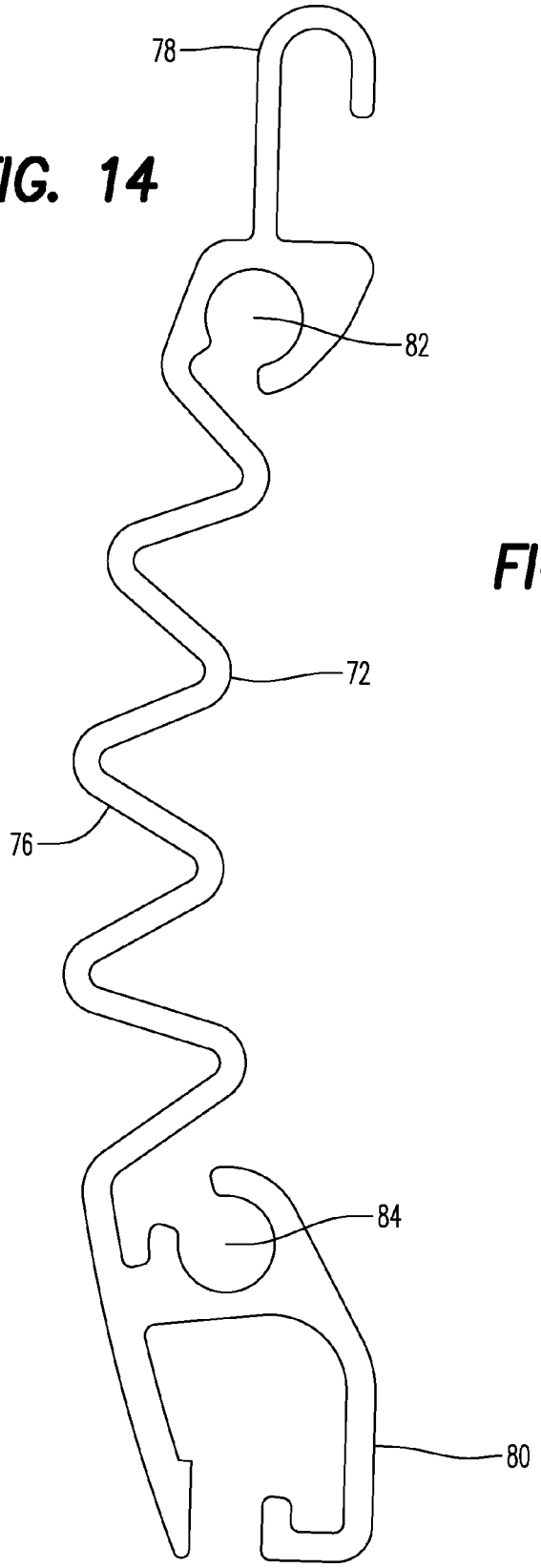
FIG. 14 is an end elevation view of the protective slat of FIGS. 12 and 13.
Figure 15:
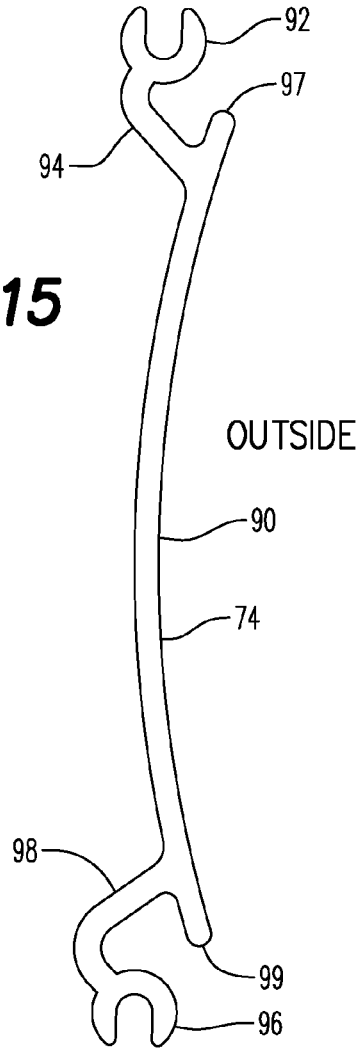
FIG. 15 is an end elevation view of the shutter slat of FIGS. 8 and 9.

Referring now to FIGS. 12 to 15, still another alternate embodiment of the invention is there shown generally at numeral 70 and includes a corrugated storm slat 72 which, as best seen in FIGS. 13 and 14, includes a series of more closely spaced zigzag or wave shaped corrugations 76 for added strength and impact resistance due to impact by airborne objects produced during severe storms and hurricanes. The interlocking edge hinges 78 and 80 are structured and function as previously described to facilitate assembly and the opening and closing hinged functioning of each adjacent connected shutter slat 72 of the storm shutter assembly 70. The longitudinally extending cavities 82 and 84 are positioned for access from the inner surface of the shutter slat 72 and are sized and spaced to slidably receive the enlarged or beaded edges 92 and 96 of an outer protective panel 74. The enlarged edges 92 and 96 are offset at 94 and 98 so as to facilitate slidable engagement lengthwise of the enlarged edges 92 and 96 into the elongated cavities 82 and 84 in the direction of arrow E in FIG. 12. This panel 74 may be extruded of metal such as aluminum, plastic, such as polycarbonate or impact absorbing rubber or vinyl to cushion and absorb impact energy from flying objects striking the outer concaved central portion 90 of the panel 74. By positioning the panel 74 and the central portion 90 thereof in very close proximity against the outwardly oriented peaks of the corrugations 76, a greater level of protection against flying object impact damage and energy absorption is provided. The concaved central portion 90 is extended at 97 and 99 to add additional strength and continuity to the outer concave surface of the shutter assembly 70 during deployment and retraction as best seen in FIG. 13.

Figures 16, 17:
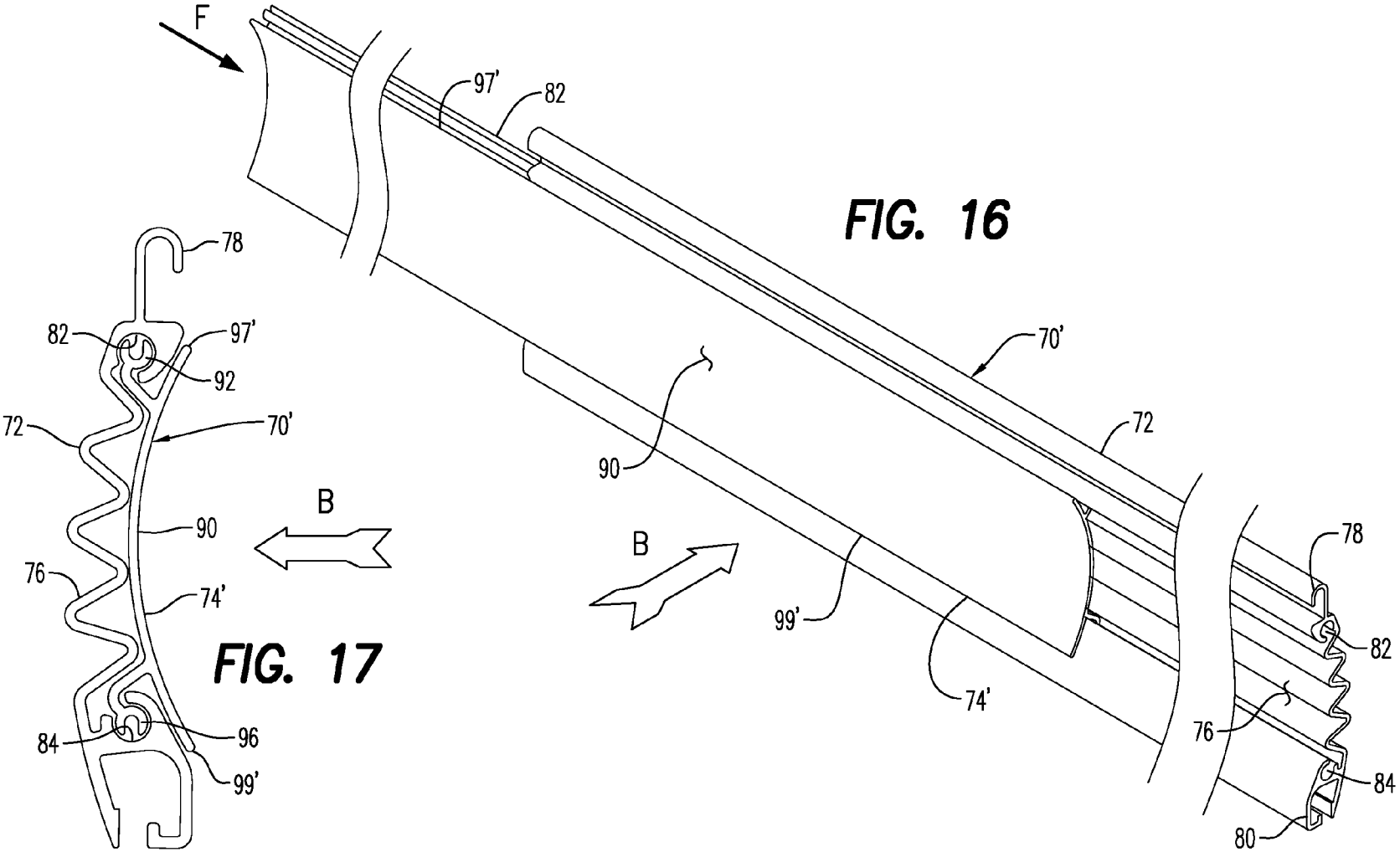
FIG. 16 is a perspective view of the embodiment of the shutter slat shown in FIG. 12 being assembled to a separate third embodiment of a protective panel.
FIG. 17 is an end elevation view of FIG. 16.
Figure 18:
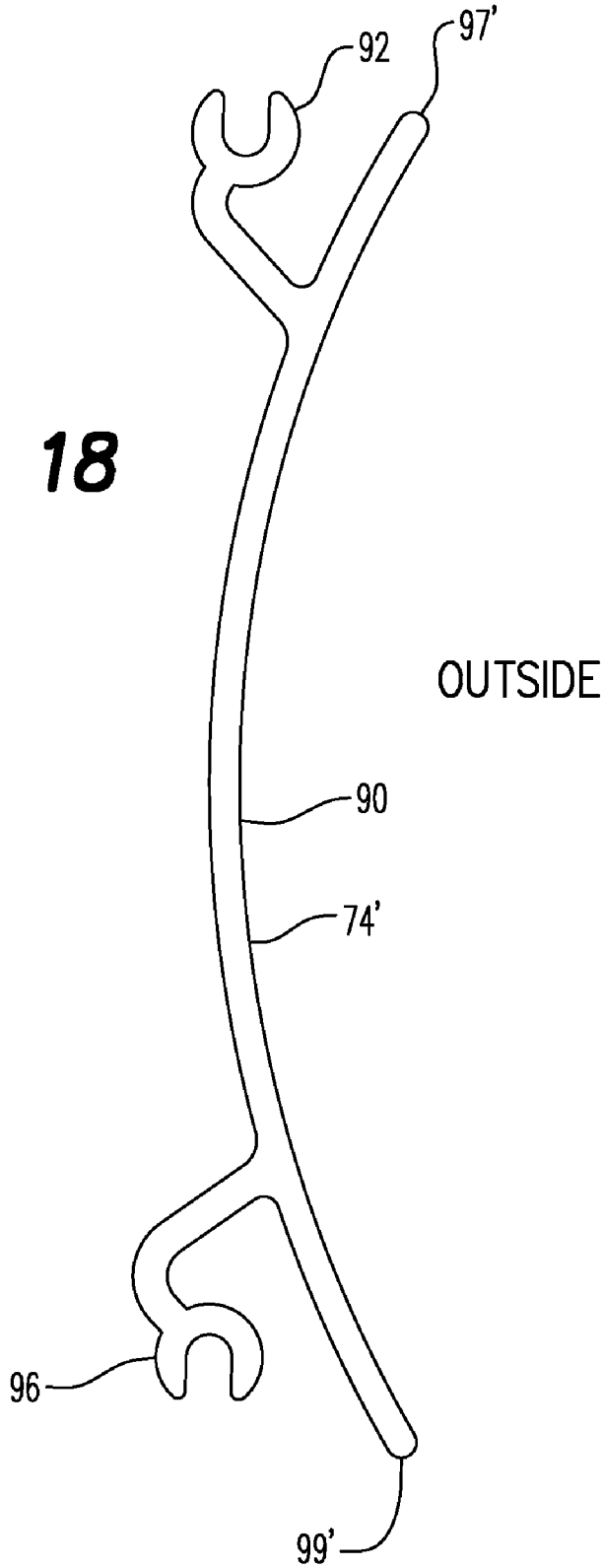
FIG. 18 is an end elevation view of protective outer panel of FIGS. 16 and 17.

Referring now to FIGS. 16 to 18, still another alternate embodiment of the invention is there shown generally at numeral 70' and includes the corrugated storm slat 72 seen in FIG. 14. The interlocking edge hinges 78 and 80 are structured and function as previously described. The longitudinally extending cavities 82 and 84 are positioned for access from the outer surface of the shutter slat 72 and are sized and spaced to receive the enlarged or beaded edges 92 and 96 of an outer protective panel 74'. This panel 74' is extruded and may be formed of metal such as aluminum, plastic, such as polycarbonate, and may also be formed of impact absorbing rubber or vinyl to cushion and absorb impact energy from flying objects striking the outer corrugated central portion 76 of the shutter slat 72. By positioning the panel 74' and the central portion 90 thereof in close proximity to or against the inner peaks of the corrugations 76, a maximum level of protection against flying object impact damage and energy absorption is provided. The enlarged edges 92 and 96 facilitate slidable engagement lengthwise of the enlarged or beaded edges 92 and 96 into the elongated cavities 82 and 84 as best seen in FIG. 16 in the direction of arrow F. The concaved central portion 90 is extended further at 97' and 99' to add even more strength and continuity to the outer concave surface of the shutter assembly 70. Note that the preferred embodiment of this panel 74' may be extruded of, or include an outer coating or film of, heat and sun-reflective material which will substantially reduce heat transfer into the interior of the building as the extruded aluminum heat transference nature of the shutter slats 72 would have an opposite effect.

Figure 19:
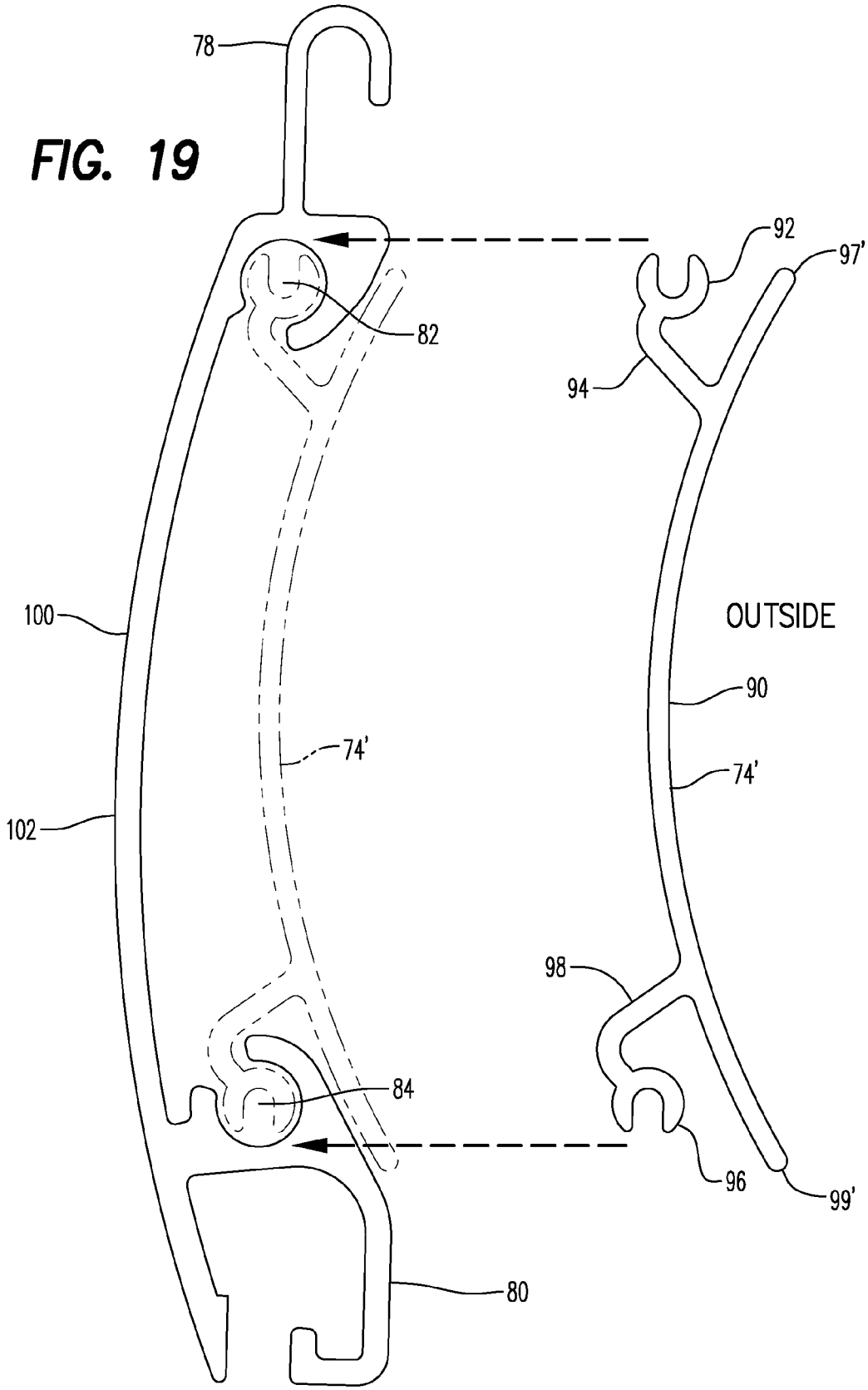
FIG. 19 is an exploded end elevation view of an uncorrugated shutter slat in combination with the panel of FIG. 18.

Referring lastly to FIG. 19, with the addition of the outer panel 74' as previously described with respect to FIG. 18, in combination with an uncorrugated storm slat 100, satisfactory impact strength to airborne flying objects during storms and hurricanes may be achieved. The storm slat 100 includes the interlocking end edge hinges 78 and 80 as previously described, along with inwardly facing longitudinally extending cavities 82 and 84 which receive the enlarged or beaded edges 92 and 96 of the panel 74'. However, in this embodiment 100, the central portion 102 thereof is uncorrugated having a generally arcuate shape with the concaved surface thereof facing outwardly and toward the panel 74' when installed as shown in phantom. Being positioned on the outer outside surface of the storm slat 100, the preferred material to be utilized in forming the panel 74' is that of a heat and light absorbing material such as a special polycarbonate material rather than being formed as an aluminum extrusion which would complicate and exaggerate the heat and sun transfer energy into the building. Alternately, a light and heat reflective coating may be applied to the concaved outer surface of the panel 74' to achieve a similar result in reflecting heat and light energy away from the interior of the building.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A roll-up type storm shutter assembly for protecting an opening of a building against flying impact damage and heat buildup, said assembly comprising:

a plurality of elongated shutter slats, each of said plurality of shutter slats includes an arcuate central portion having a first edge and a second edge, each of said first edge and said second edge having outwardly extending mating portions complimentarily configured to engage with a mating portion of an adjacent shutter slat for limited pivotal movement, said plurality of shutter slats moveable between a rolled up position and a rolled down position, each of said shutter slats having an interior side facing the opening of the building in the rolled down position and an opposite exterior side having a concave shape, each of said first edge and said second edge having an elongated groove positioned opposite said mating portions and facing a center of said central portion; and a plurality of elongated protective panels having an arcuate shape corresponding to said central portion, said protective panels having a length corresponding to a length of said shutter slats, each protective panel having an interior surface that faces the exterior side of said shatter slat, a pair of offset tabs that extend generally outwardly from said interior surface of said protective panel between side end portions of said interior surface of said protective panel, each one of said pair of tabs having a shaped edge portion positioned on a distal end of each of said pair of tabs, said shaped edge portions being spaced apart from said interior surface of said protective panel, said shaped edge portions configured to be slidably received within one of said elongated grooves of said central portion, said plurality of protective panels acting as an insulator to prevent heat transfer between said plurality of shutter slats and the opening.

2. The roll-up type storm shutter assembly of claim 1, wherein each of said pair of tabs are positioned inwardly from each of said ends of said plurality of protective panels such that said side end portions of each of said plurality of protective panels extends beyond said shaped edge portions and said grooves formed in said of said plurality of shutter slats, and wherein a portion of each of said grooves of said shutter slats is positioned between a shaped edge portion and a portion of said interior side of said plurality of said protective panels.

3. The roll-up type storm shutter assembly of claim 2, wherein said exterior side of said plurality of protective panels includes a coating of reflective material to reduce heat transfer into the opening of the building.

4. The roll-up type storm shutter assembly of claim 1, wherein said plurality of elongated shutter slats are formed of a metallic material, and wherein said plurality of protective panels are formed of a heat resistant material.

5. The roll-up type storm shutter assembly of claim 4, wherein said grooves have openings facing towards said central portion.

6. The roll-up type storm shutter assembly of claim 5, wherein said grooves are formed on said exterior side of said central portion, and wherein said plurality of protective panels have an interior side and an opposite exterior side, said interior side of said plurality of protective panels faces said exterior side of said central portion of said plurality of shutter slats so as to prevent said plurality of shutter slats from heating due to exposure to sunlight.

7. The roll-up type shutter assembly of claim 6, wherein said central portion is formed having a plurality of corrugations having a plurality of outwardly facing corrugations peaks, and wherein said interior side of said plurality of protective panels contacts said plurality of peaks of said plurality of corrugations.

* * * * *